US006012176A

United States Patent [19]

Daley, III

[11] Patent Number: 6,012,176

[45] Date of Patent: Jan. 11, 2000

[54] VISOR SUPPORTED DISPLAY SYSTEM

[76] Inventor: Charles A. Daley, III, 10 Woodgate Ct., Hillsbourough, Calif. 94010

[21] Appl. No.: 09/233,951

[22] Filed: Jan. 20, 1999

[51] Int. Cl.[7] ..... A42B 1/24

[52] U.S. Cl. ..... 2/209.13; 2/906; 40/329; 345/8

[58] Field of Search ..... 2/6.1, 6.2, 195.1, 2/209.13, 422, 906; 40/329; 345/8

[56] References Cited

U.S. PATENT DOCUMENTS 5,708,449 1/1998 Heachock et al. ..... 345/8

*Primary Examiner*—Diana Oleksa
*Attorney, Agent, or Firm*—Goldstein & Canino

[57] ABSTRACT

A visor supported display system may be worn by a user to enable visual information to be selectively viewed by the user. The visor supported display is arranged with a housing including a main portion that is fixable to an underside of a visor. A movable portion of the housing is movably fixed to the main portion so that it may be moved to a down or open position so that visual information can be viewed. When the viewing of the visual information is no longer necessary, the movable portion may be moved to a closed or up position, improving the forward looking view of the user. A source of the visual information may most preferably be provided separate to, and external of, the visor supported display.

15 Claims, 5 Drawing Sheets

VISOR SUPPORTED DISPLAY SYSTEM

BACKGROUND OF THE INVENTION

1. Field of the Invention

The present invention relates to display devices and systems. More particularly, the invention relates to a personal visor supported display a wearer employs to selectively view visual information, while enabling increased forward looking visibility when the visual information is not being viewed.

2. Background and Objects of the Invention

The advent of micro-electronic systems has lead to the development of a large variety of personal electronic systems that may be belt worn or carried in a pocket of a user. Examples of such systems include stereo cassette players, Compact disk players, AM/FM radios, handheld games, wireless telephones, televisions, specialized and general purpose computers, etc. These devices always include means to support the exchange of information with the user. For example, when considering a portable stereo cassette, a pair of headphones and a simple arrangement of controls may be provided as such a means.

When considering the need to support the delivery of visual information (including text and or visual images) to a user via a hands free arrangement, it should be noted that presently available personal display arrangements significantly restrict the forward looking view or vision of a wearer. For example, U.S. Pat. No. 5,708,449 to Heacock et al. teaches a "binocular head mounted display system". However, the Heacock display arrangement, as well as others available in the art, are fixed in position. Such devices significantly or totally restrict the forward looking view of a user. Accordingly, if a wearer of such a display needs an improved forward looking view, the display must be lifted and or removed. It would be desirable to have a display arrangement that enables a wearer to selectively view visual information (when necessary), while still allowing at least limited forward looking vision to be maintained. In addition, a display means would be most preferred that significantly improves a forward looking view when said visual information does not need to be viewed.

Accordingly, the present invention provides new and improved visor supported display arrangements having one or more of the following capabilities, features, characteristics, and or advantages:

- a compact, self-contained visor supportable display arrangement;
- constructed with a simple housing having a main portion and a moveable portion;
- the movable portion movable from a closed position (providing at least a partial forward looking view to the wearer) to an open position which enables visual information to be viewed by a wearer;
- includes at least one active display element within a display module to present the visual information to a user/wearer;
- may include an interface module to operatively couple the visor display to a visual information source to enable visual information to be received and displayed by the visor supported display;
- may include a reflective surface fixed to the movable portion to enable a reflection of an image produced by the display module to be viewed by a wearer;
- head worn display arrangement possibly receiving power from the visual information source;

- simple architecture; and
- economical construction using a number of off-the-shelf parts and components.

The above listed capabilities, characteristics, and or associated novel features of the present invention, as well as others, will become clear from a careful review of the description and figures provided herein. Attention is called to the fact, however, that the drawings and descriptions are illustrative only. Variations are contemplated as being part of the invention, limited only by the scope of the appended claims.

SUMMARY OF THE INVENTION

In accordance with the present invention, a visor supported display is provided for use with a head mounted visor worn by a wearer. The visor supported display, which enables visual information to be selectively viewed by the wearer, includes a housing having a main portion that is structured to be fixable to an underside of the visor. A movable (bottom) portion is movably fixed to the main portion of the housing, and provides access to an interior cavity. The movable portion of the housing is structured so as to enable a wearer to selectively move the movable portion between a closed (up) position or an open (down) position. When in the open position a display means mounted within the housing enables the wearer of the visor to view visual information. When visual information is no longer being viewed, the movable portion may be moved to a closed position, significantly improving the forward looking view of a wearer.

The visual information provided to the wearer may preferably be provided to separate active display elements of at least one display module. Further, each display module would be preferably mounted in the main portion of the housing with a reflective surface suitably mounted to the movable portion. The display module is oriented so that the wearer may view the visual information via a reflected image of the visual information (provided by the active display elements). At least one lens may be interposed between the active display element(s) of the display module and the reflective surface. The lens may be arranged to magnify the image of the visual information provided by the display module that is reflected and viewed by the wearer. The reflective surface may also be suitably curved, say in a concaved fashion, to provide a desired magnification effect, and or any other controlled and desired image distortion.

As a function of a particular external visual information source being used, as well as the architecture of the visor supported display, an interface module may be provided in addition to the display module. The interface module would enable visual information to be received from the visual information source and displayed for viewing by a user.

BRIEF DESCRIPTION OF THE DRAWINGS

In the drawings, like elements are assigned like reference numerals. The drawings are not necessarily to scale, with the emphasis instead placed upon the principles of the present invention. Additionally, each of the embodiments depicted are but one of a number of possible arrangements utilizing the fundamental concepts of the present invention. The drawings are briefly described as follows.

LIST OF REFERENCE NUMERALS USED IN THE DRAWINGS

18—cap (having a visor)
20—visor supported display or visor display
24—main portion (of housing)
24*a*—partition support wall
26—movable portion (of housing)
28—interior cavity
28*a*—opening
30—visor (or bill)
34—hinge means
40—reflective surface
44—display module
44*a*—active display element (of display module)
46—interface module (electronics)
50—lens
60—visual information source
64—user interface
70—power regulator
72—battery
74—switch means
76—on-off switch
80—coupling means

DETAILED DESCRIPTION OF THE PREFERRED EMBODIMENTS

Figure 1A:
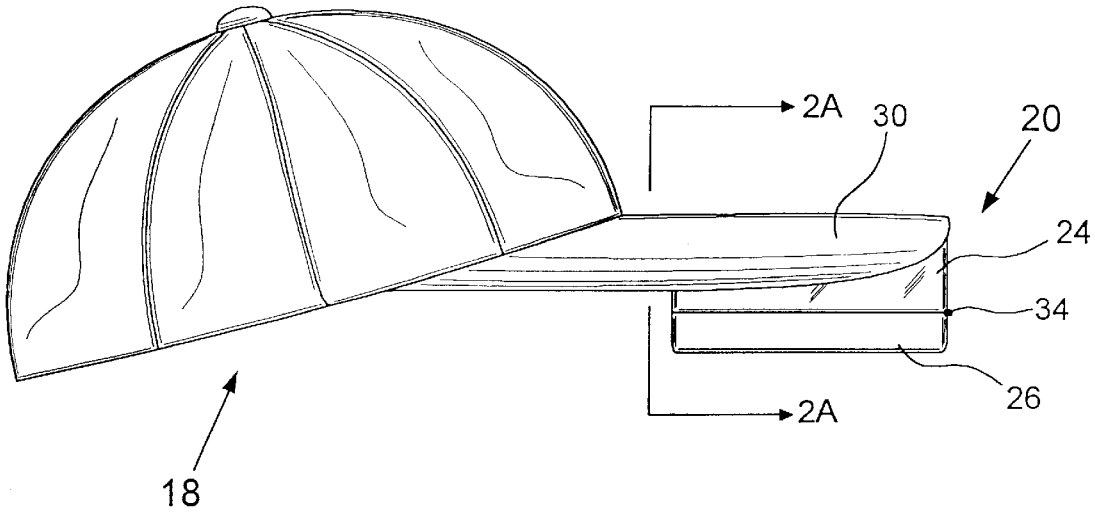
FIGS. 1A and 1B depict a profile view of a visor supported display system in accordance with the present invention.
Figure 1B:
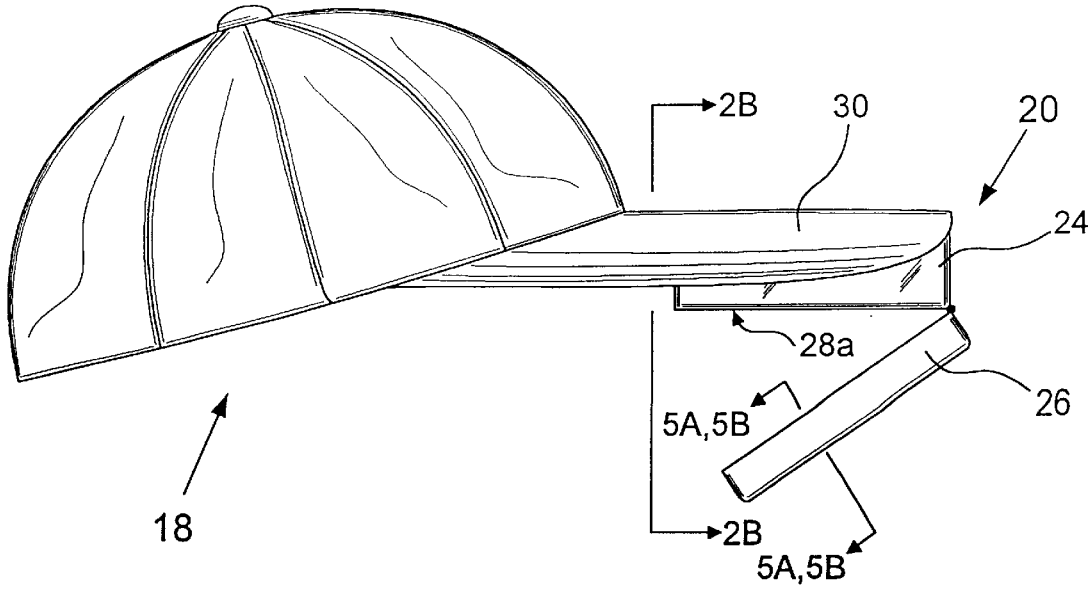

It is important to establish the definition of several terms that will be used throughout this disclosure. The term 'visor' is to be defined as a forward extending bill extending somewhat horizontally from the forehead of a wearer. Accordingly, the position of the visor is essentially above the forward looking line of sight of a wearer. The visor may be provided as part of a cap, or simply have a strap for maintaining the desired position as illustrated in FIGS. 1A and 1B. The term 'housing', which is well known to skilled persons, provides a shell or case that houses and or supports essential elements of the display system. The expression 'discrete visual information' indicates the display system can provide a binocular view, enabling one or more images of visual information to be viewed. That is, each eye of the wearer may view different visual information. Additional terms and expressions will be defined below, as required.

Turning now to FIG. 1A, there is depicted a profile view of a visor supported display (system) 20 that may be worn by a wearer. The embodiment illustrated is fixed to a baseball style cap 18. The visor supported display 20, as can be seen in FIGS. 1A and 1B, includes a main portion 24 that may be fixed to an underside of the visor 30. The main portion 24 of the housing is formed to provide an interior cavity 28 (best seen in FIG. 3) with an opening 28*a*. The opening 28*a* provides access to the interior cavity 28, which is arranged to hold items including electronic circuits and a suitable display module 44. A movable portion 26 in further provided that is movably fixed the main portion 24 by a hinge means 34 so as to be movable between a closed (up) position and an open (down) position. When the moveable portion 26 is in the closed position, as shown in FIG. 1A, the opening 28*a* is substantially covered or closed. Alternately, when the movable portion 26 is in the open position, as shown in FIG. 1B, an image of the visual information to be viewed by a wearer is available, preferably preserving a portion of the forward looking vision or view of the wearer. At minimum, preferred embodiments of the visor supported display will enable a user to see the ground immediately in front of him/her while the movable portion 26 is in the open position. Clearly, the forward looking view or vision of the wearer may also be significantly increased by the wearer simply lifting or tilting his/her head back. This action will allay the need of the wearer to lift or remove the visor supported display 20 to gain increased vision.

Figure 2A:
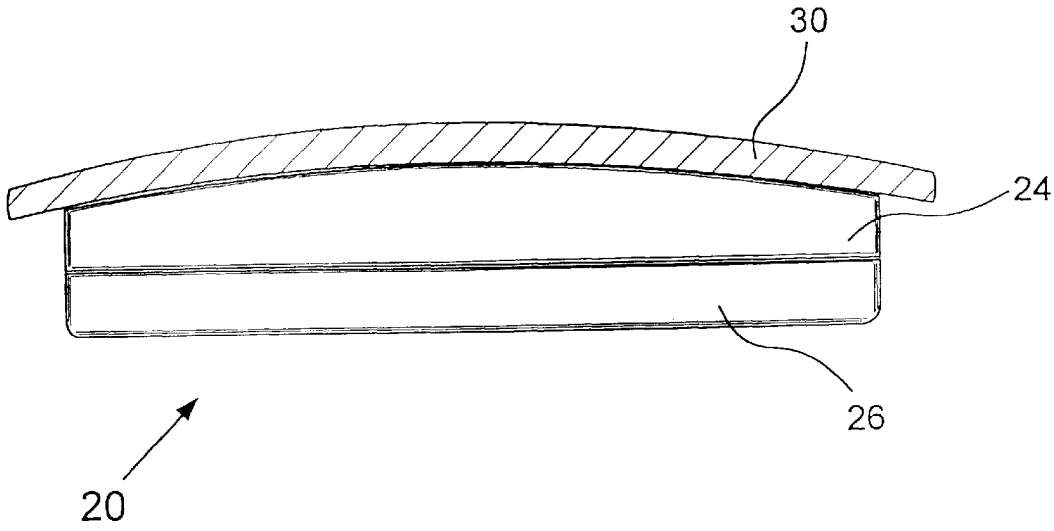
FIGS. 2A and 2B provide views of the display system as seen from the perspective of a wearer taken from the line 2A—2A of FIG. 1A and taken from the line 2B—2B of FIG. 1B, respectively.
Figure 2B:
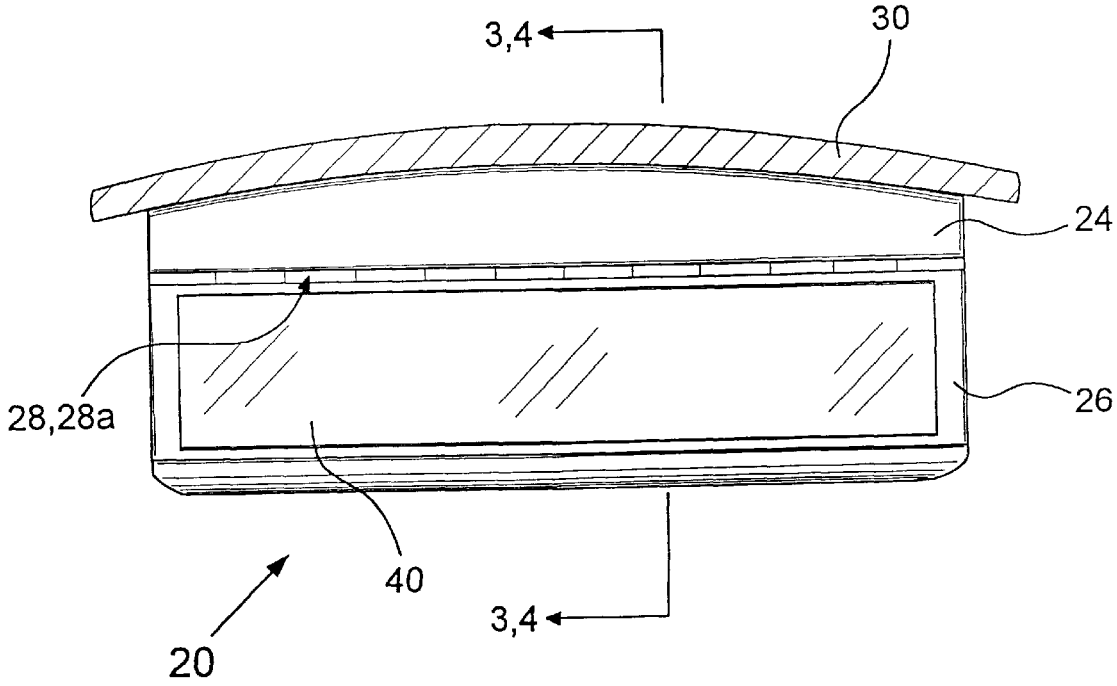

Turning to FIGS. 2*a* and 2*b*, views of the visor supported display from the vantage point of a wearer/user are depicted. FIG. 2A, which is taken from view of line 2A—2A of FIG. 2A, illustrates a forward looking view with the movable portion 26 in the closed position. As can be seen, when the movable portion 26 is in the closed position, the forward looking view of the wearer is significantly improved. FIG. 2B, which is taken from view of line 2B—2B of FIG. 1A, illustrates a forward looking view with the movable portion 26 in the down position. As shown in FIG. 2B when the movable portion 26 is in the down position, the preferred embodiments of the invention have a reflective surface 40 fixed to the movable portion 26. The reflective surface 40 will be discussed in detail below.

Figure 3:
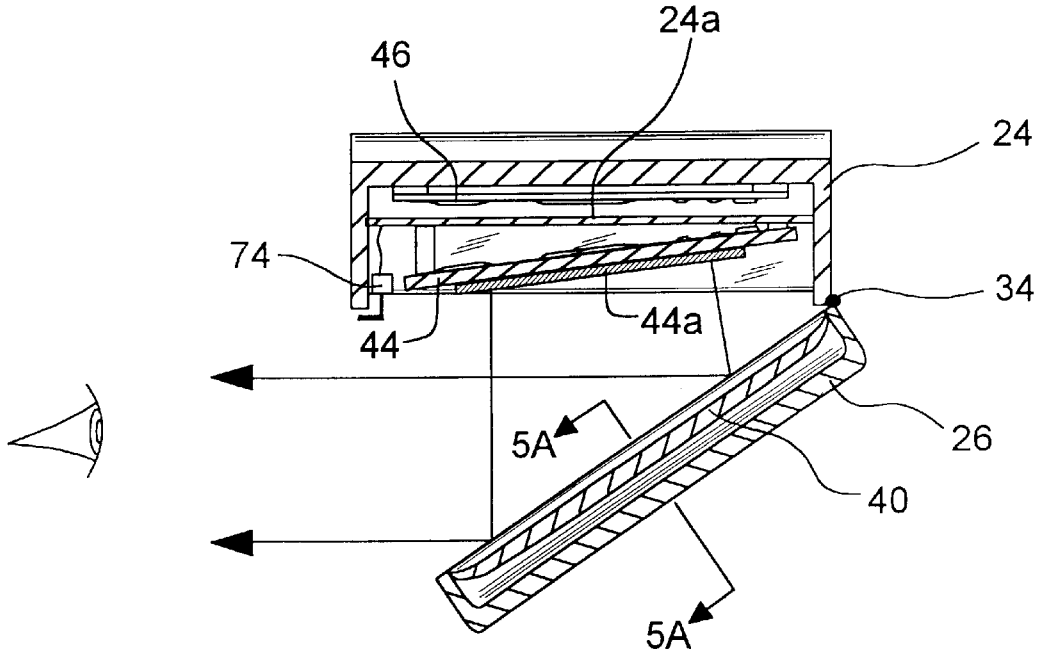
FIG. 3 illustrates a cross sectional view of an embodiment of the display system with a movable portion in the open or down position.
Figure 4:
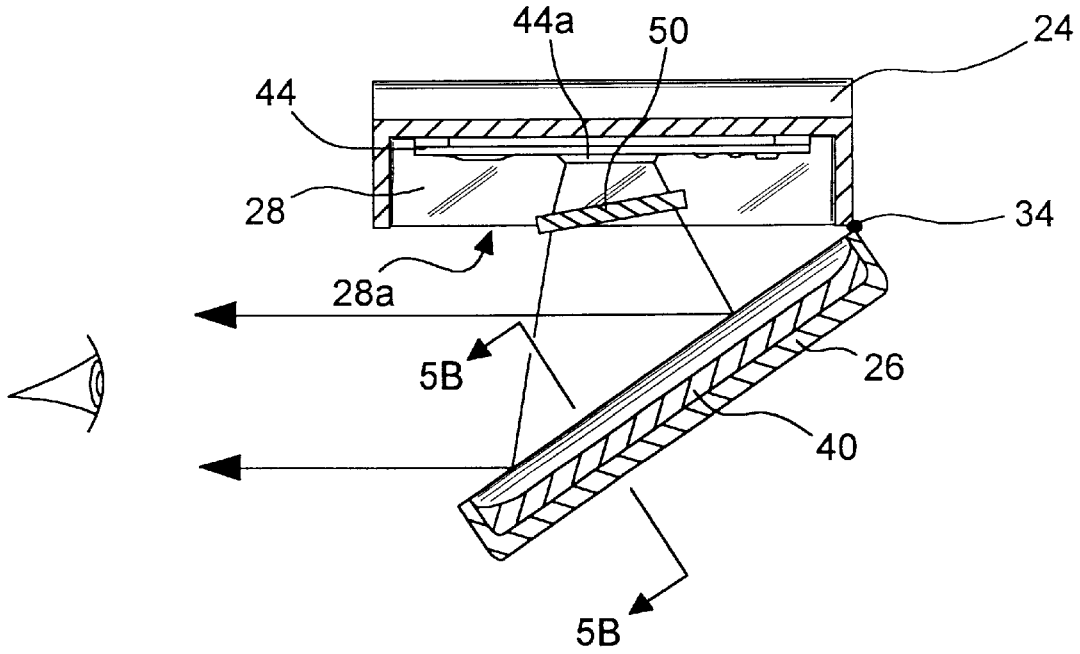
FIG. 4 illustrates a cross sectional view of an another embodiment of the invention.

Referring now to FIGS. 3 and 4, cross section side view of the visor supported display 20 are depicted. A display means is provided to enable an image of the visual information to be viewed by the wearer. The display means would include a suitable display module 44, which is preferably mounted in the main portion 24 of the housing, to produce an image of the visual information. The image may be magnified by lens 50, when included, which may be employed as shown in FIG. 4, or in other suitable known arrangements. It should be noted that the mounting angle of any included active display elements 44*a* may be at a substantially different angles from that depicted in FIGS. 3 and 4.

A reflective surface 40, as can be seen in FIGS. 2B through 5B, is suitably mounted to an inner surface 26*a* of the movable portion 26 of the housing. The reflective surface 40 and suitable geometry's of the active display elements 44*a* of the display module 44 enable a wearer of the visor 30 to view the visual information provided by the display module 44 via a reflection when the movable portion 26 is in the open position.

Figure 6:
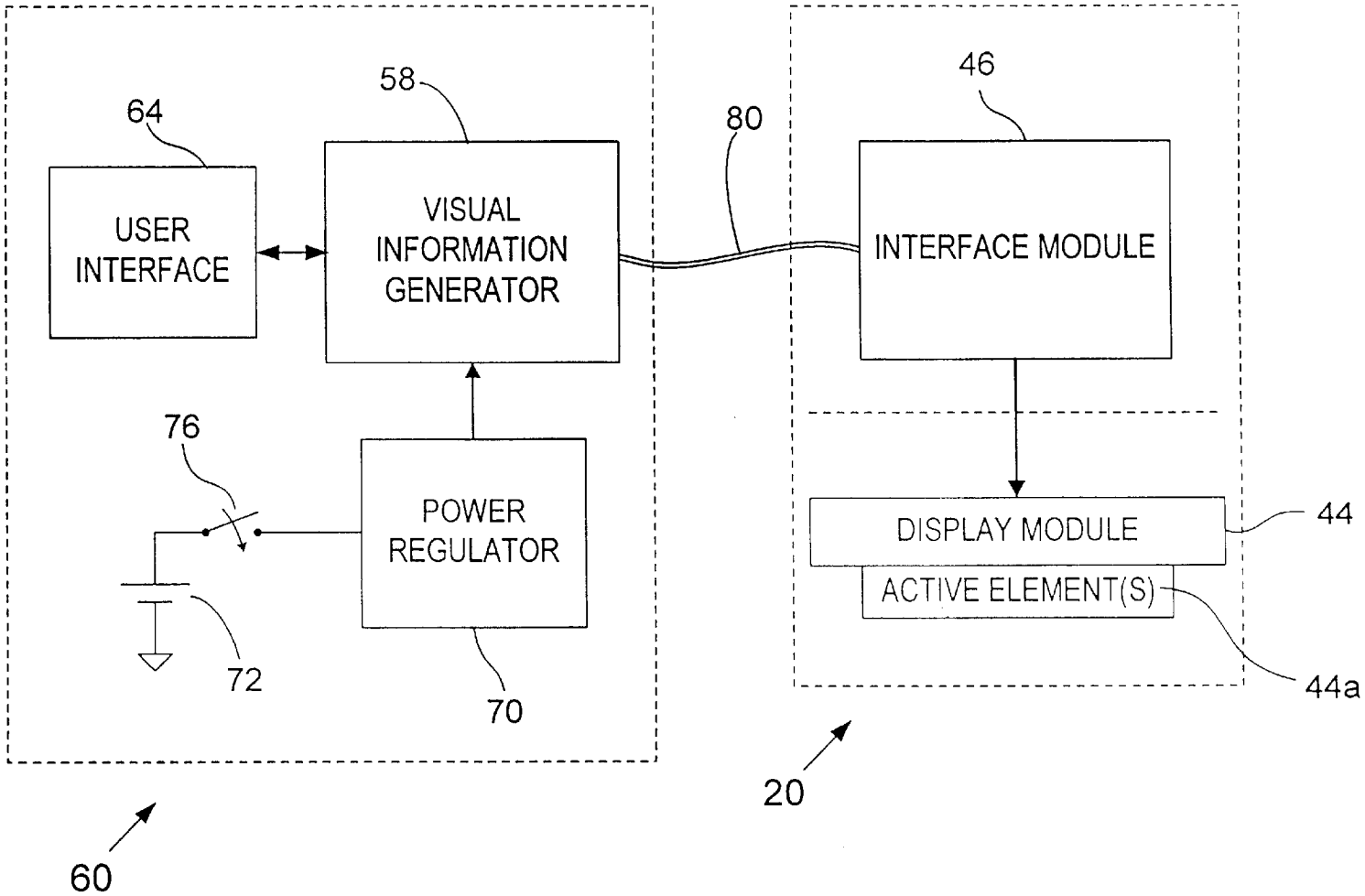
FIG. 6 is a high-level functional block diagram a preferred embodiment in accordance with the present invention.

As shown in FIGS. 3, 4, and 6, an interface module 46 may be included that enables a visual information source 60, external to the visor supported display 20, to deliver (supply) information to the active display elements 44*a* of the display module 44. The received information is available for viewing by the wearer (assuming the movable portion 26 is in the open position). It should be noted that the electronic circuitry of the interface module 46 and the display module 44 are to be defined broadly. As such, the required components may be provided in such a manner that these units may be combined, either partially or entirely. Accordingly, a single circuit board may be employed, as shown in FIG. 4, or a plurality of circuit boards may be employed as shown in FIG. 3. Skilled persons will also recognize the circuitry required for the interface and display module 44 may vary considerably as a function of the source of the information, as well as the particular active display elements 44*a* included with the displace module 44. Therefore, the interface unit 46 and display module 44 are to be broadly defined with each providable by complicated circuits available in the art. As can be seen in FIG. 3, the main portion 24 of the housing may include a partition support wall 24*a*. The partition support wall 24*a* enables the interface module 46 to be mounted under the display module 44 (and the active display elements 44*a* thereof).

Importantly, the visual information delivered to a wearer is available to the wearer 'hands-free'. A most preferable embodiment would simply require a user to open or flip down the movable portion 26, and the information may be viewed. Accordingly, it is contemplated that a switch means 74, for example a micro-switch, may be provided to turn off the visor supported display when the movable portion 26 is in the closed position, and turn on the visor supported display when the movable portion 26 is placed in the open position.

Figure 5A:
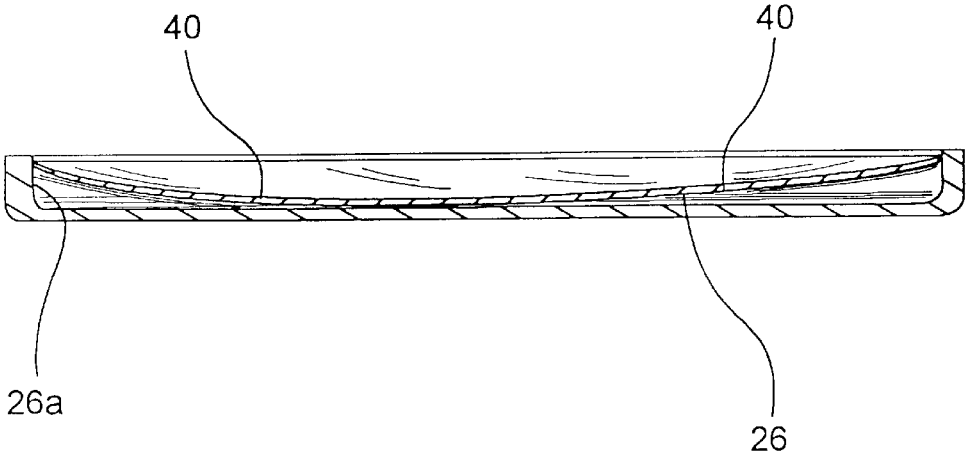
FIG. 5A provides a cross sectional view of the movable portion taken along the line 5A—5A of FIG. 3.
Figure 5B:
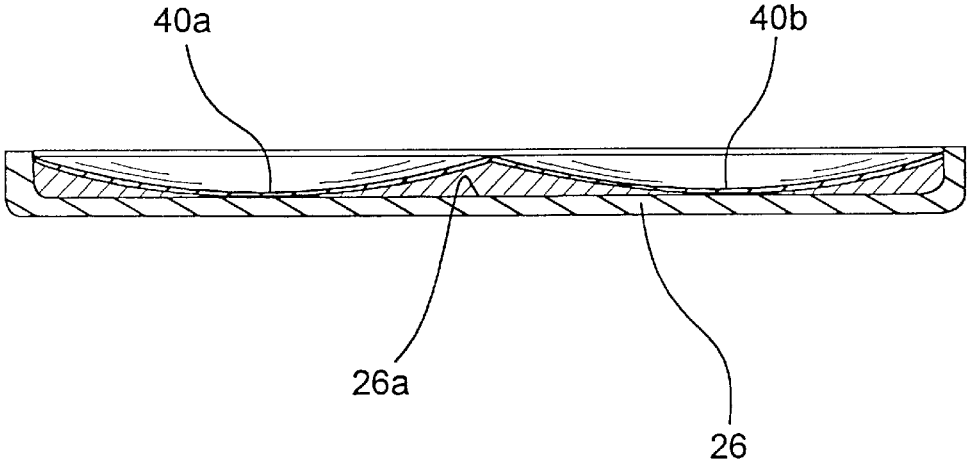
FIG. 5B provides a cross sectional view of the movable portion taken along the line 5B—5B of FIG. 4.

Turning now to FIGS. 5A and 5B, several embodiments of the reflective surface 40 are depicted. In FIG. 5A a simple embodiment of the reflective surface 40 is shown with a slightly concaved shape. In contrast, the embodiment of FIG. 5B provides a binocular reflection surface having two equivalent concaved regions. It is contemplated that the arrangement of FIG. 5B may best be embodied with a pair of active display elements. Each active display element 44*a* may further generate a distinctive image of visual information to be viewed by the user/wearer. The concaved shape depicted in FIGS. 5A and 5B provides a reflective surface 40 that may be used to magnify or controllably distort (in a desired manner) the image of the visual information provided by the display module 44 that is reflected and viewed by the wearer.

Referring to FIG. 6, there is provided a high-level functional block diagram of a preferred embodiment of the invention. A visual information source 60 may include various electronic and or electro-mechanical devices that provide the function of the visual information generator 58. A user interface 64 may be provided with the visual information source 60 for setup, configuration, and operation. A power regulator 70 may also be included to regulate a power source such as a battery 72. A switch, such as on-off switch 76 may be provided to enable the wearer, either directly or indirectly, to power up and down the visual information source 60 and or the visor supported display 20. As can be seen in FIG. 4, a switch means 74 may be provided that may be arranged to turn off the visor supported display 20, and possibly the visual information source 60. A coupling means 80, preferably provided by a suitable electronic cable, may be included that enables the visual information source 60 to deliver the visual information to the interface module 46 and or the display module 44.

As skilled persons will appreciate, the functional convenience provided by the structure of the present invention may be especially suited to small self-contained computer systems that may be termed 'wearable computers'. Wearable computers are essentially very portable computer systems that are strapped or suitably fixed to a person. The person may use the computer of entertainment purposes such as playing games, or important on-the-job related work activities or functions.

It is important to understand that the description of the embodiments of the visor supported display 20 provided herein are illustrative only, and other equivalent arrangements are certainly possible. For example, an embodiment of the display module 44 of FIG. 3 may include an active display element 44*a*, say provided by a high resolution liquid crystal display (LCD) type of display. It should also be understood, that the LCD display may be mounted to the movable portion 26 of the housing, with the reflective surface 40 omitted. Therefore, the main portion 24 of the housing may simply contain electronic circuits, including the interface module 46 and any required power supply or regulator circuitry. As skilled persons will appreciate, as a function of cost and capability, a large plurality of other and further modifications may be made without departing from the present invention. Therefore, it is intended to claim all such modifications and variations as fall within the scope of the appended claims.

What is claimed is:

1. A visor supported display in combination with a head mounted visor worn by a wearer for enabling visual information to be selectively viewed by the wearer, the visor supported display comprising:

a) a housing including an main portion that is fixed to an underside of the visor having a downwardly oriented opening providing access to a interior cavity;

b) a movable portion of the housing that is movably fixed to the main portion by a hinge means which is structured so as to enable a wearer to selectively move the movable portion between a closed position or an open position;

c) display means mounted within the housing to enable the wearer of the visor to view visual information via the display means when the movable portion of the housing is in the open position; and d) an interface module that enables a visual information source, external to the visor supported display, to source information to be displayed by the display means.

2. The combination in accordance with claim 1, wherein the display means is comprised of a reflective surface suitably mounted to the movable portion and a display module that is mounted in the cavity of the main portion of the housing, the reflective surface enabling a reflected image of the visual information provided by the display module to be viewed by the wearer.

3. The combination in accordance with claim 2, further including at least one lens that is interposed in between an active display element of the display module and the reflective surface to magnify the image of the visual information provided by the display module for the wearer to view.

4. The combination in accordance with claim 3, wherein a pair of spaced active display elements are provided and configured to supply visual information to each eye of a wearer to enable the viewing of discrete visual information.

5. The combination in accordance with claim 2, wherein the reflective surface is curved to magnify the image of the visual information provided by the display module that is reflected and viewed by the wearer.

6. The combination in accordance with claim 5, wherein the head mounted visor supporting the visor supported display is provided by a baseball style cap.

7. A visor supported display in combination with a visor worn by a wearer for enabling visual information to be viewed by the wearer, the visor supported display comprising:

a) a housing including a main portion that is fixed to an underside of the visor, the main portion of the housing forming an interior cavity with a downward oriented opening providing access thereto;

b) a movable portion of the housing is movably fixed to the main portion of the housing and movable between a closed position and an open position, with the movable portion significantly covering the opening to the main portion of the housing when in the closed position;

c) a display module mounted in the cavity of the main portion of the housing that produces an image of the visual information;

d) a reflective surface suitably mounted to an inner surface of the movable portion of the housing to enable a wearer to view the visual information provided by the display module via a reflection when the movable portion is in the open position; and e) means to enable a visual information source external to the visor supported display to supply information by way of the display module to the wearer for viewing.

8. The combination in accordance with claim 7, wherein the reflective surface is curved to distort the image of the visual information provided by the display module in a controlled and desired manner.

9. The combination in accordance with claim 8, wherein the head mounted visor supporting the visor supported display is provided by a baseball style cap.

10. The combination in accordance with claim 7, further including at least one lens structured to magnify the image of the visual information provided by the display module that is reflected and viewed by the wearer.

11. The combination in accordance with claim 10, wherein the lens interposed in line between the display module and the reflective surface.

12. The combination in accordance with claim 10, further including a switch means to turn on the visor supported display when the movable portion is in the open position, and turn off the visor supported display when the movable portion is in the closed position.

13. A visor supported display in combination with a head supported visor worn by a wearer to enable visual information to be selectively viewed by the wearer, the visor supported display comprising:

a) housing including a main portion that is fixed to an underside of the visor and a movable portion that is movably fixed to the main portion, the main portion of the housing forming an interior cavity with an opening providing access thereto;

b) the movable portion of the housing is movable between a closed position and an open downwardly extending position, wherein the movable portion significantly covers and closes the opening to the main portion when in the closed position;

c) a display module that produces visual information that may be viewed by a wearer when the movable portion is in the down position; and d) an interface module that enables information provided by an external visual information source to be receivable by the visor supported display and viewed by the wearer when the movable portion is in the open position.

14. The combination in accordance with claim 13, further including a switch means to turn on the visor supported display when the movable portion is in the open position, and turn off the visor supported display when the movable portion is in the closed position.

15. The combination in accordance with claim 14, wherein the active element of the display module is provided by at least one liquid crystal display.

* * * * *